US011457728B2

(12) United States Patent
Leng

(10) Patent No.: US 11,457,728 B2
(45) Date of Patent: Oct. 4, 2022

(54) FOLDABLE TABLE BENCH

(71) Applicant: New-Tec Integration (Xiamen) Co., Ltd., Xiamen (CN)

(72) Inventor: Luhao Leng, Xiamen (CN)

(73) Assignee: NEW-TEC INTEGRATION (XIAMEN) CO., LTD., Fujian (CN)

( * ) Notice: Subject to any disclaimer, the term of this patent is extended or adjusted under 35 U.S.C. 154(b) by 0 days.

(21) Appl. No.: 17/188,523

(22) Filed: Mar. 1, 2021

(65) Prior Publication Data

US 2021/0177135 A1 Jun. 17, 2021

Related U.S. Application Data

(63) Continuation of application No. PCT/CN2019/102613, filed on Aug. 26, 2019.

(30) Foreign Application Priority Data

Aug. 27, 2018 (CN) ..... 201810982553.X

(51) Int. Cl.
*A47B 3/14* (2006.01)

(52) U.S. Cl.
CPC ..... *A47B 3/14* (2013.01); *A47B 2003/145* (2013.01)

(58) Field of Classification Search
CPC ..... A47B 2003/145; A47B 3/14; A47B 39/06
USPC ..... 297/158.4
See application file for complete search history.

(56) References Cited

U.S. PATENT DOCUMENTS 3,174,796 A * 3/1965 Brown ..... A47B 3/14
297/158.4
3,276,815 A 10/1966 Cardy
3,574,393 A 4/1971 Hughes
(Continued)

FOREIGN PATENT DOCUMENTS

CN 101426398 A 5/2009
CN 205197375 U 5/2016
CN 108294462 A * 7/2018 ..... A47B 3/14
(Continued)

OTHER PUBLICATIONS

International Search Report and English Translation as cited in PCT/CN2019/102613; dated Nov. 27, 2019, 8 pages.
(Continued)

*Primary Examiner* — Milton Nelson, Jr.
(74) *Attorney, Agent, or Firm* — Cooper Legal Group LLC

(57) ABSTRACT

The present disclosure a foldable table bench having a folded state and an unfolded state, the foldable table bench comprises a frame, a table board, and a bench board. The frame comprises two supporting rods vertically disposed side by side and back and forth, the frame is disposed with link rod mechanisms corresponding to the bench board, and the link rod mechanisms are respectively connected to bottom portions of the supporting rods. Each of the link rod mechanisms comprises a swing arm and a connecting arm rotatably connected together, the swing arm is supported on ground, the swing arm is rotatably connected to the supporting rod, the connecting arm is disposed with a connecting shaft, the connecting shaft supports a bottom portion of the bench board, and the connecting shaft is disposed along a width direction of the bench board and is rotatably connected to the bench board.

15 Claims, 12 Drawing Sheets

(56) References Cited

U.S. PATENT DOCUMENTS

| | | | |
|---|---|---|---|
| 3,650,560 | A | 3/1972 | Wohlk |
| 2004/0070235 | A1 | 4/2004 | Gregory |

FOREIGN PATENT DOCUMENTS

| | | | |
|---|---|---|---|
| CN | 108294462 | A | 7/2018 |
| CN | 109549341 | A | 4/2019 |
| CN | 209284468 | U | 8/2019 |
| GB | 2064949 | A | 6/1981 |
| JP | 3094199 | U | 6/2003 |

OTHER PUBLICATIONS

Written Opinion and English Translation as cited in PCT/CN2019/102613; dated Nov. 27, 2019, 9 pages.

* cited by examiner

FOLDABLE TABLE BENCH

RELATED APPLICATIONS

This application a continuation application of International Patent Application PCT/CN2019/102613, filed on Aug. 26, 2019, which claims priority to Chinese patent application number 201810982553.X, filed Aug. 27, 2018. International Patent Application PCT/CN2019/102613 and Chinese patent application number 201810982553.X are incorporated herein by reference.

FIELD OF THE DISCLOSURE

The present disclosure relates to a foldable table bench.

BACKGROUND OF THE DISCLOSURE

In a foldable table bench, the table board and bench board are together hinged on the frame. The table board and the bench board can be unfolded and folded. The table board, the bench board, and the frame are combined together for use, which is convenient for use and occupies small storage space, and foldable table bench is very suitable for outdoor use.

In the existing foldable table bench, both sides of the bench board and the frame are connected by slider mechanisms, and there is a rotation axis between the bench board and the slider mechanisms. When the bench board is unfolded, the rotation axis on two sides of the bench board are not in a straight line, and the bench board cannot be turned over to ensure the stability of use. In the process of folding, the frame drives the slider mechanisms on both sides of the bench board to slide, the rotation axis on both sides of the bench board is adjusted to the same straight line, and the bench board can be turned and folded.

In the existing foldable table bench, in the process of folding and unfolding, the slider mechanisms on both sides of the bench board need to be slide along an arc. During the process of unfolding and folding, the bench board needs to maintain straightness. That is, the slider mechanisms on both sides of the bench board need to be synchronized. Otherwise, the slider mechanisms are prone to jamming when sliding. That is to say, the unfolding and folding of the bench board is not smooth, and the structure of the slider mechanisms is also very complicated. In particular, if the bench board is long, a person cannot operate the slider mechanisms on both sides at the same time using two arms, and the folding operation is inconvenient.

BRIEF SUMMARY OF THE DISCLOSURE

The present disclosure provides a foldable table bench with a simple structure and configured to be smoothly unfolded and folded.

In order to solve the technical problems of the present disclosure, a technical solution of the present disclosure is as follows.

A foldable table bench having a folded state and an unfolded state, comprises a frame, a table board disposed on one side of the frame, and a bench board disposed on the one side of the frame. The frame comprises two supporting rods vertically disposed side by side and back and forth, the frame is disposed with a pair of link rod mechanisms corresponding to the bench board, and the link rod mechanisms are respectively connected to bottom portions of the supporting rods. Each of the link rod mechanisms comprises a swing arm and a connecting arm rotatably connected together, the swing arm is supported on ground, the swing arm (i.e., an outer end of the swing arm) is rotatably connected to the supporting rod, the connecting arm (i.e., an outer end of the connecting arm) is disposed with a connecting shaft, the connecting shaft supports a bottom portion of the bench board, and the connecting shaft is disposed along a width direction of the bench board and is rotatably connected to the bench board. In the unfolded state, the link rod mechanisms support a lower side of the bench board to enable the bench board to be maintained in a horizontal position. In the folded state, the connecting arms and the bench board rotate toward the supporting rods to enable the bench board to be switched to a vertical position and the swing arms and the connecting arms rotate toward an inner side of the bench board and abut the bottom portion of the bench board.

In a preferred embodiment, in the folded state, the connecting shafts and a rotation axis between the swing arms and the supporting rods define a straight line.

In a preferred embodiment, the bottom portions of the supporting rods are disposed with C-shaped frames, and inner ends of the swing arms are disposed in the C-shaped frames and are rotatably connected to the C-shaped frames. In the folded state, the bench board stands on the C-shaped frames and abuts outer sides of the supporting rods.

In a preferred embodiment, the connecting arms bend to define C-shapes.

In a preferred embodiment, a middle portion of a bottom surface of the bench board is longitudinally disposed with a reinforcing rod, and a connecting rod is connected between the connecting arm and the reinforcing rod. A first end of the connecting rod is pivotally connected to the connecting arm, a second end of the connecting rod is pivotally connected to a sliding sleeve, the sliding sleeve is slidably disposed on the reinforcing rod, the reinforcing rod is disposed with an insertion hole, and the sliding sleeve is disposed with a movable pin. In the unfolded state, the movable pin is disposed in the insertion hole.

In a preferred embodiment, two sides of the table board are pivotally connected to top portions of the supporting rods, the frame is disposed with a pair of crossbars corresponding to the table board, and the crossbars are respectively and rotatably connected to the top portions of the supporting rods. In the unfolded state, the crossbars support a lower side of the table board to enable the table board to be maintained in the horizontal position. In the folded state, the crossbars rotate and abut an inner side of the table board and the table board rotates downward to be vertically positioned.

In a preferred embodiment, outer ends of the crossbars are disposed with convex points, a bottom surface of the table board is disposed with snapping blocks corresponding to the crossbars, the snapping blocks are disposed with sliding grooves defining arc-shapes and corresponding to the convex points, and ends of the sliding grooves define positioning holes. In the unfolded state, the convex points are maintained in the positioning holes.

In a preferred embodiment, left sides and right sides of top ends of the supporting rods are respectively disposed with connecting pieces, and the connecting pieces are pivotally connected to the table board.

In a preferred embodiment, a side of the table board is disposed with baffles configured to cover the connecting pieces from an outside.

In a preferred embodiment, two sides of the table board are pivotally connected to top portions of the supporting rods, two sides of a bottom portion of the table board are disposed with two guide rods corresponding to the supporting rods, the guide rods are disposed with sliding bases, the sliding bases are configured to slide along the guide rods, the guide rods comprise lock holes, the sliding bases are disposed with movable pins, bearing rods are disposed between the sliding bases and the supporting rods, and two ends of the bearing rods are respectively and pivotally connected to the sliding bases and the supporting rods. In the unfolded state, the movable pins are disposed in the lock holes, and the bearing rods support a lower side of the table board to enable the table board to be maintained in the horizontal position. In the folded state, the movable pins are pulled out from the lock holes and the table board rotates downward to be vertically positioned.

In a preferred embodiment, a pull rod is connected between the guide rods disposed below the table board, the pull rod is rotatably connected to the guide rods, the pull rod is operatively connected to the movable pins of the sliding bases, and the pull rod rotates to drive the movable pins to be pulled out from the lock holes.

In a preferred embodiment, a top surface of the bench board comprises space-giving grooves corresponding to the supporting rods. In the folded state, the space-giving grooves are buckled on the supporting rods.

In a preferred embodiment, a left side and a right side of the frame are symmetrically disposed with two of the table boards, and a left side and a right side of the frame are symmetrically disposed two of the bench boards.

A foldable table bench having a folded state and an unfolded state comprises a frame, a pair of table boards symmetrically disposed on a left side and a right side of the frame, and a pair of bench boards symmetrically disposed on the left side and the right side of the frame. The frame comprises two supporting rods vertically disposed side by side and back and forth, the frame is disposed with a pair of link rod mechanisms corresponding to each of the bench boards, and the link rod mechanisms corresponding to each of the bench boards are respectively connected to bottom portions of the supporting rods. Each of the link rod mechanisms comprises a swing arm and a connecting arm rotatably connected together, the swing arm is supported on ground, the swing arm is rotatably connected to the supporting rod, the connecting arm is disposed with a connecting shaft, the connecting shaft supports a bottom portion of one of the bench boards, and the connecting shaft is disposed along a width direction of the one of the bench boards and is rotatably connected to the one of the bench boards. In the unfolded state, the link rod mechanisms support lower sides of the bench boards to enable the bench boards to be maintained in a horizontal position. In the folded state, the connecting arms and the bench boards rotate toward the supporting rods to enable the bench boards to be switched to a vertical position and the swing arms and the connecting arms rotate toward inner sides of the bench boards and abut the bottom portions of the bench boards.

In a preferred embodiment, the table boards are pivotally connected to top portions of the supporting rods, the frame is disposed with a pair of crossbars corresponding to each of the table boards, and the crossbars corresponding to each of the table boards are respectively and rotatably connected to the top portions of the supporting rods. In the unfolded state, the crossbars support lower sides of the table boards to enable the table boards to be maintained in the horizontal position. In the folded state, the crossbars rotate and abut inner sides of the table boards and the table boards rotate downward to be vertically positioned.

In a preferred embodiment, the table boards are pivotally connected to top portions of the supporting rods, bottom portions of the table boards are disposed with two guide rods corresponding to the supporting rods, the guide rods are disposed with sliding bases, the sliding bases are configured to slide along the guide rods, the guide rods comprise lock holes, the sliding bases are disposed with movable pins, bearing rods are disposed between the sliding bases and the supporting rods, and two ends of the bearing rods are respectively and pivotally connected to the sliding bases and the supporting rods. In the unfolded state, the movable pins are disposed in the lock holes, and the bearing rods support lower sides of the table boards to enable the table boards to be maintained in the horizontal position. In the folded state, the movable pins are pulled out from the lock holes and the table boards rotate downward to be vertically positioned.

In a preferred embodiment, a pull rod is connected between the guide rods disposed below the table boards, the pull rod is rotatably connected to the guide rods, the pull rod is operatively connected to the movable pins of the sliding bases, and the pull rod rotates to drive the movable pins to be pulled out from the lock holes.

In a preferred embodiment, top surfaces of the bench boards comprise space-giving grooves corresponding to the supporting rods. In the folded state, the space-giving grooves are buckled on the supporting rods.

A foldable table bench having a folded state and an unfolded state comprises a frame, a pair of table boards symmetrically disposed on a left side and a right side of the frame, and a pair of bench boards symmetrically disposed on the left side and the right side of the frame. The frame comprises two supporting rods vertically disposed side by side and back and forth, the frame further comprises a middle board connected to top portions of the supporting rods, the table boards are respectively and pivotally connected to the middle board, the frame is disposed with a pair of link rod mechanisms corresponding to each of the bench boards, and the link rod mechanisms corresponding to each of the bench boards are respectively connected to bottom portions of the supporting rods. Each of the link rod mechanisms comprises a swing arm and a connecting arm rotatably connected together, the swing arm is supported on ground, an outer end of the swing arm is rotatably connected to the supporting rod, an outer end of the connecting arm is disposed with a connecting shaft, the connecting shaft supports a bottom portion of one of the bench boards, and the connecting shaft is disposed along a width direction of the one of the bench boards and is rotatably connected to the one of the bench boards. In the unfolded state, the table boards are horizontally positioned and are disposed in a plane with the middle board, the middle board is disposed between the table boards, the link rod mechanisms support lower sides of the bench boards to enable the bench boards to be maintained in a horizontal position. In the folded state, the table boards rotate downward to be vertically positioned, the connecting arms and the bench boards rotate toward the supporting rods to enable the bench boards to be switched to a vertical position, and the swing arms and the connecting arms rotate toward an inner side of the bench boards and abut the bottom portions of the bench boards.

In a preferred embodiment, the frame is disposed with a pair of crossbars corresponding to each of the table boards, and the crossbars corresponding to each of the table boards are respectively and rotatably connected to the top portions of the supporting rods. In the unfolded state, the crossbars support lower sides of the table boards to enable the table boards to be maintained in the horizontal position. In the folded state, the crossbars rotate and are stored below the middle board and the table boards rotate downward to be vertically positioned.

In a preferred embodiment, bottom portions of the table boards are disposed with two guide rods corresponding to the supporting rods, the guide rods are disposed with sliding bases, the sliding bases are configured to slide along the guide rods, the guide rods comprise lock holes, the sliding bases are disposed with movable pins, bearing rods are disposed between the sliding bases and the supporting rods, and two ends of the bearing rods are respectively and pivotally connected to the sliding bases and the supporting rods. In the unfolded state, the movable pins are disposed in the lock holes, and the bearing rods support lower sides of the table boards to enable the table boards to be maintained to be horizontally positioned. In the folded state, the movable pins are pulled out from the lock holes, and the table boards rotates downward to be vertically placed.

In a preferred embodiment, a pull rod is connected between the guide rods disposed below the table boards, the pull rod is rotatably connected to the guide rods, the pull rod is operatively connected to the movable pins of the sliding bases, and the pull rod rotates to drive the movable pins to be pulled out from the lock holes.

In a preferred embodiment, top surfaces of the bench boards comprise space-giving grooves corresponding to the supporting rods. In the folded state, the space-giving grooves are buckled on the supporting rods.

A method for folding a foldable table bench, comprises a frame, a table board disposed on one side of the frame, and a bench board disposed on the one side of the frame. The frame comprises two supporting rods disposed side by side, the frame is disposed with a pair of link rod mechanisms corresponding to the bench board, and the link rod mechanisms are respectively connected to bottom portions of the supporting rods. Each of the link rod mechanisms comprises a swing arm and a connecting arm, the connecting arm is rotatably connected to the swing arm, the swing arm is supported on ground, the swing arm is rotatably connected to the supporting rod, the connecting arm support a bottom portion of the bench board and are pivotally connected to the bench board. A folding method is as follows: the connecting arms and the bench board rotate toward the frame to enable the bench board to be switched to be substantially parallel to the supporting rods. The swing arms bring the connecting arms to rotate toward a center of the bench board to be substantially disposed on the bottom portion of the bench board.

In a preferred embodiment, the connecting arms are disposed with connecting shafts, the connecting shafts support the bottom portion of the bench board, and the connecting shafts are disposed along a width direction of the bench board and are rotatably connected to the bench board.

In a preferred embodiment, the table board is pivotally connected to top portions of the supporting rods, the frame is disposed with a pair of crossbars corresponding to the table board, and the crossbars are respectively and rotatably connected to the top portions of the supporting rods. In an unfolded state, the crossbars support a lower side of the table board to enable the table board to be maintained in a horizontal position. In a folded state, the crossbars rotate and abut an inner side of the table board and the table board rotates downward to be vertically positioned.

A foldable table bench comprises a frame, a table board disposed on one side of the frame, and a bench board disposed on the one side of the frame. The frame comprises two supporting rods disposed side by side, the frame is disposed with a pair of link rod mechanisms corresponding to the bench board, and the link rod mechanisms are respectively connected to bottom portions of the two supporting rods. Each of the link rod mechanisms comprises a swing arm and a connecting arm, the connecting arm supports the bench board, a rotational relationship is defined between the swing arm and the supporting rod, a second rotational relationship is defined between the swing arm and the connecting arm, and a third rotational relationship is defined between the connecting arm and the bench board. The bench board rotates due to folding and unfolding the link rod mechanism. A folding method is as follows: the connecting arms and the bench board rotate toward the frame to enable the bench board to be switched to be substantially parallel to the supporting rods, and the swing arms bring the connecting arms to rotate toward a center of the bench board to be substantially disposed on a bottom portion of the bench board.

In a preferred embodiment, two sides of the table board are pivotally connected to top portions of the supporting rods, the frame is disposed with a pair of crossbars corresponding to the table board, and the crossbars are respectively and rotatably connected to the top portions of the supporting rods. In an unfolded state, the crossbars support a lower side of the table board to enable the table board to be maintained in a horizontal position. In a folded state, the crossbars rotate and abut an inner side of the table board and the table board rotates downward to be vertically positioned.

In a preferred embodiment, the frame comprises a middle board connected to the top portions of the two supporting rods, two sides of the table board are respectively and pivotally connected to the middle board, and the table board is configured to rotate relative to the middle board.

In a preferred embodiment, a left side and a right side of the frame are symmetrically disposed with two of the table boards, and a left side and a right side of the frame are symmetrically disposed with two of the bench boards.

Compared with the existing techniques, the technical solution has the following advantages.

The swing arm and the connecting arm are rotatably connected together. In the folded state, the connecting arm and the bench board can be rotated together so that the bench board can be directly switched to the folded state, and the bench board can be folded with only one action. The operation is very fast and easy. Moreover, even if the bench board has a long length, when folding and unfolding, the bench board can drive the connecting arms on both sides to rotate at the same time, so one person can perform the operation, which is convenient for use. The present disclosure forms a rotation relationship between the swing arm and the supporting rod, forms another rotation relationship between the swing arm and the connecting arm, and forms a third rotation relationship between the connecting arm and the bench board. The folding and unfolding of the link rod mechanism directly drives the rotating of the bench board, and the structure is very simple.

BRIEF DESCRIPTION OF THE DRAWINGS

The present disclosure will be further described below in combination with the accompanying drawings and embodiments.

DETAILED DESCRIPTION OF THE EMBODIMENTS

Figure 1:
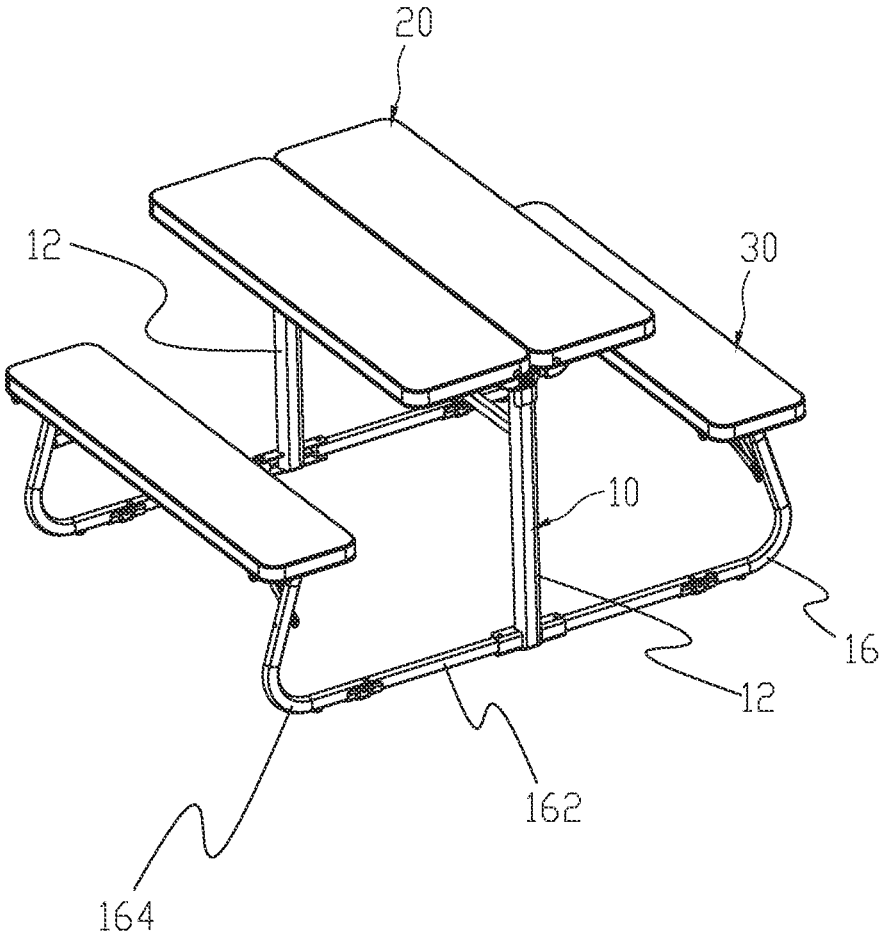
FIG. 1 illustrates a perspective view of a foldable table bench disposed in an unfolded state of Embodiment 1 of the present disclosure.
Figure 2:
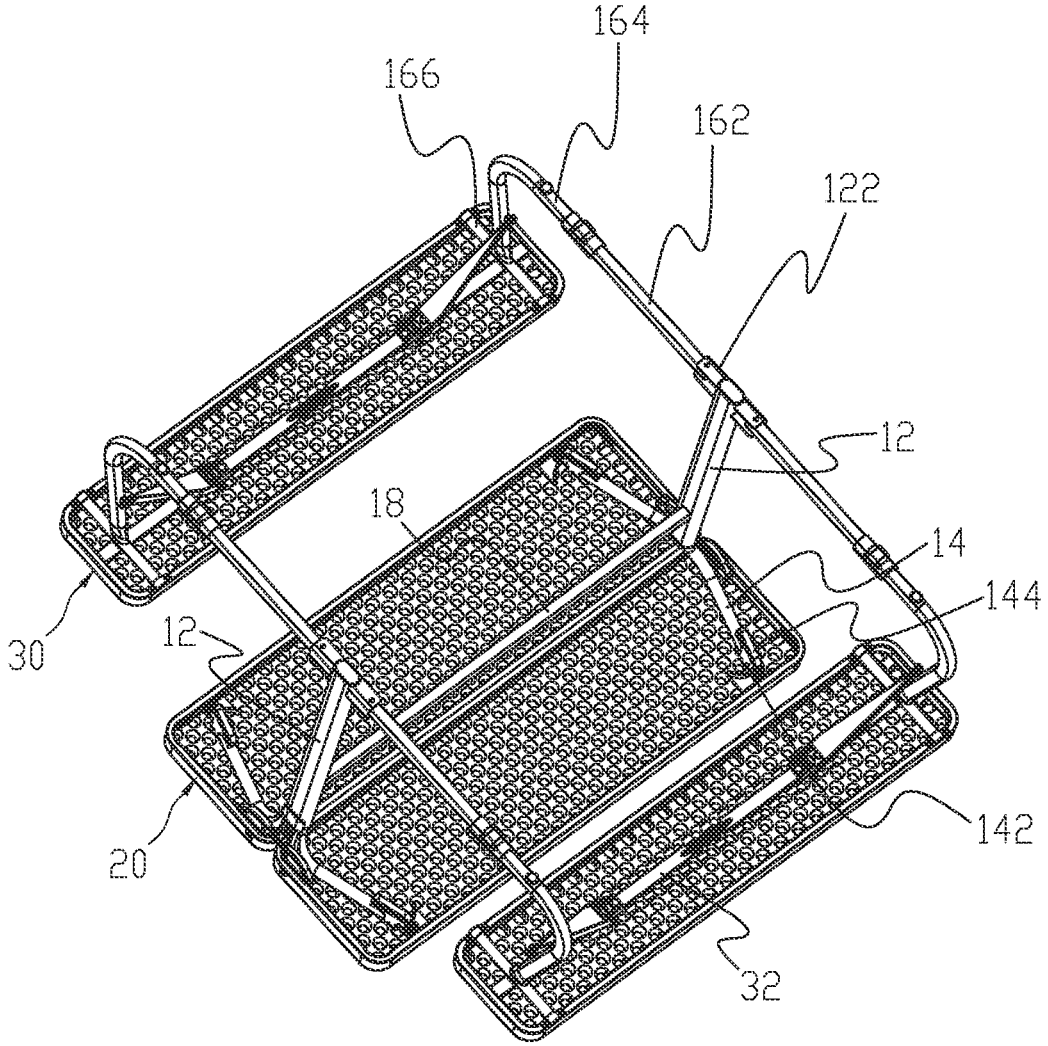
FIG. 2 illustrates another perspective view of the foldable table bench shown in FIG. 1 and disposed in the unfolded state.

Referring to FIGS. 1 and 2, a foldable table bench comprises a frame 10, a pair of table boards 20 symmetrically disposed on a left side and a right side of the frame 10, and a pair of bench boards 30 symmetrically disposed on the left side and the right side of the frame 10. The table boards 20 and the bench boards 30 are horizontally positioned when disposed in an unfolded state.

The frame 10 comprises two supporting rods 12 vertically disposed side by side and back and forth, and two sides of the table boards 20 are respectively and pivotally connected to top portions of the two supporting rods 12. The frame 10 is disposed with a pair of crossbars 14 corresponding to each of the table boards 20. The crossbars 14 corresponding to each of the table boards 20 are respectively and rotatably connected to the top portions of the two supporting rods 12, and the crossbars 14 are configured to rotate in a horizontal plane. The crossbars 14 support lower sides of the table boards 20 to enable the table boards 20 to be maintained in a horizontal position.

The frame 10 is disposed with a pair of link rod mechanisms 16 corresponding to each of the bench boards 30, and the link rod mechanisms 16 corresponding to each of the bench boards 30 are respectively connected to bottom portions of the two supporting rods 12 configured to support the bench boards 30. The link rod mechanisms 16 comprise swing arms 162 and connecting arms 164 rotatably connected together. The swing arms 162 are supported on the ground, and the connecting arms 164 are configured to rotate toward the swing arms 162 to abut upper sides of the swing arms 162. Outer ends of the swing arms 162 are rotatably connected to the connecting arms 164, and inner ends of the swing arms 162 are pivotally connected to the two supporting rods 12 to rotate toward an inner side of the frame 10 in a horizontal plane. Outer ends of the connecting arms 164 are disposed with connecting shafts 166. The connecting shafts 166 are configured to support bottom portions of the bench boards 30, and the connecting shafts 166 are disposed along width directions of the bench boards 30 and are rotatably connected to the bench boards 30. The link rod mechanisms 16 support lower sides of the bench boards 30, and the bench boards 30 are maintained in the horizontal position.

Figure 3:
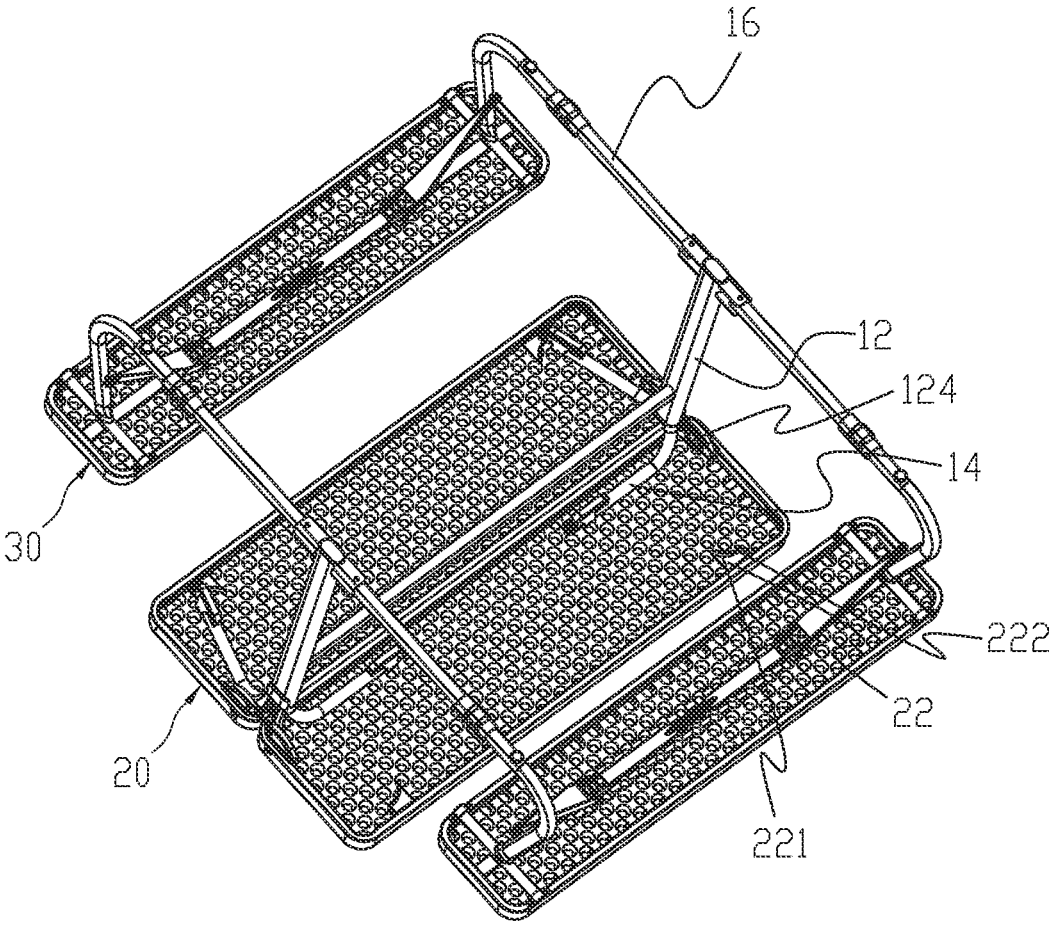
FIG. 3 illustrates a perspective view of the foldable table bench shown in FIG. 1 after a crossbar disposed below a table board of the foldable table bench is folded.
Figure 4:
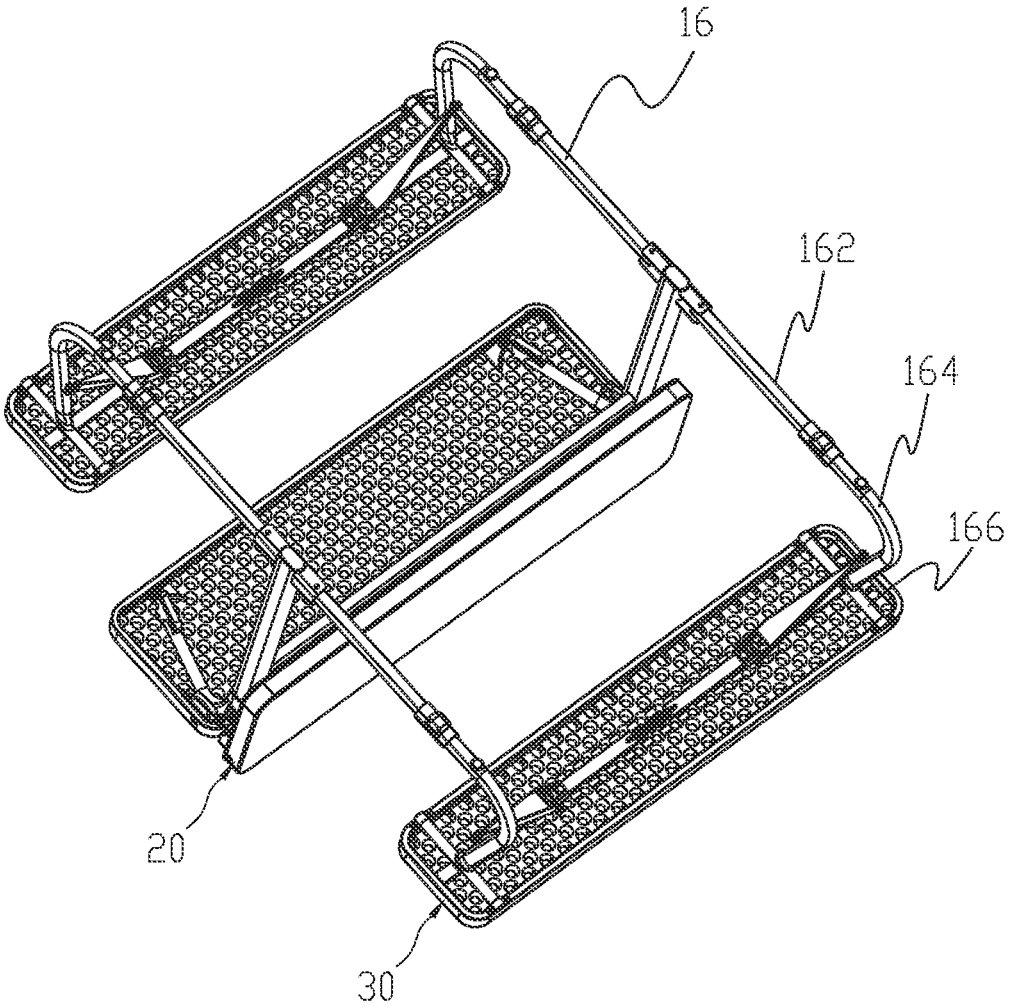
FIG. 4 illustrates a perspective view of the foldable table bench shown in FIG. 1 after the table board is folded.

Referring to FIGS. 3 and 4, in a folded state, the crossbars 14 rotate toward the inner side of the frame 10 to abut inner sides of the table boards 20, and the table boards 20 are configured to rotate downward to be vertically positioned.

Figure 5:
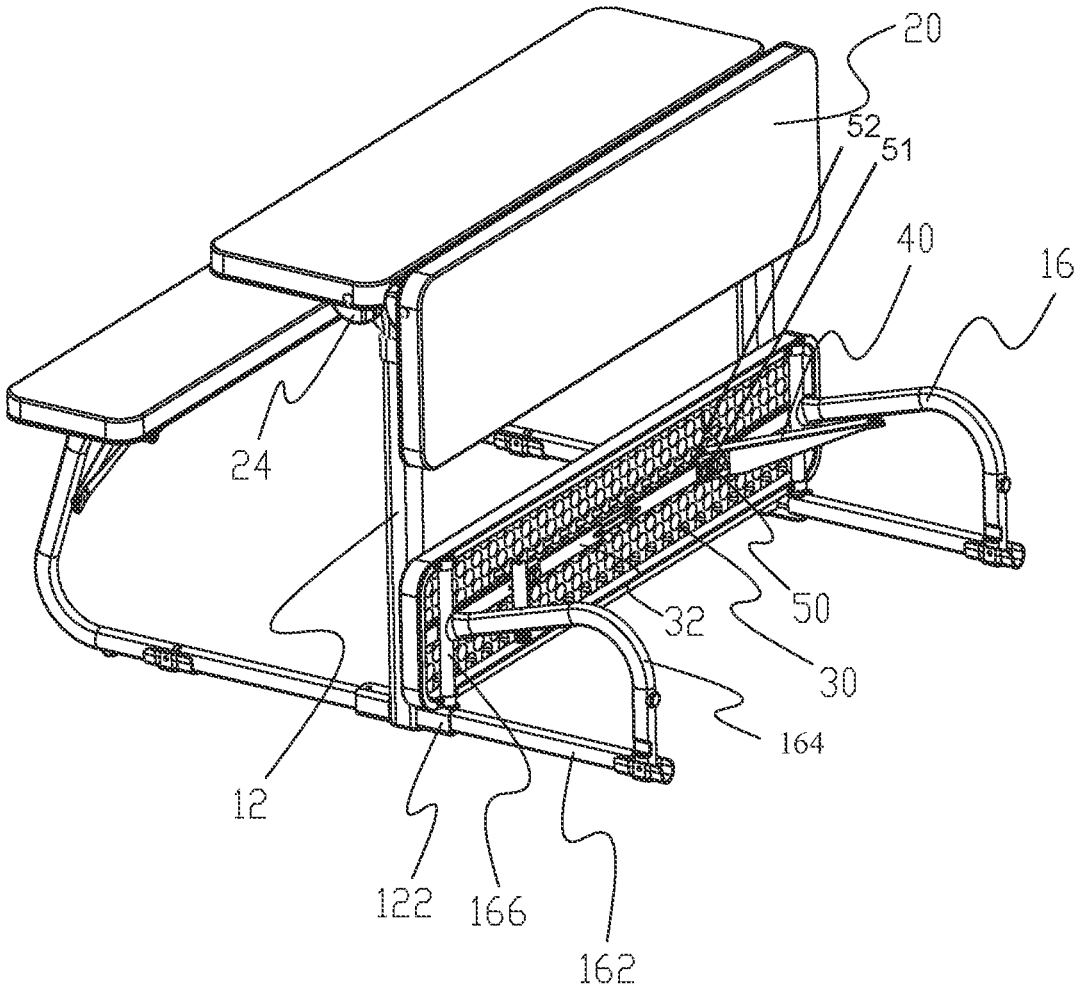
FIG. 5 illustrates a perspective view of the foldable table bench shown in FIG. 1 after a bench board of the foldable table bench is folded.
Figure 6:
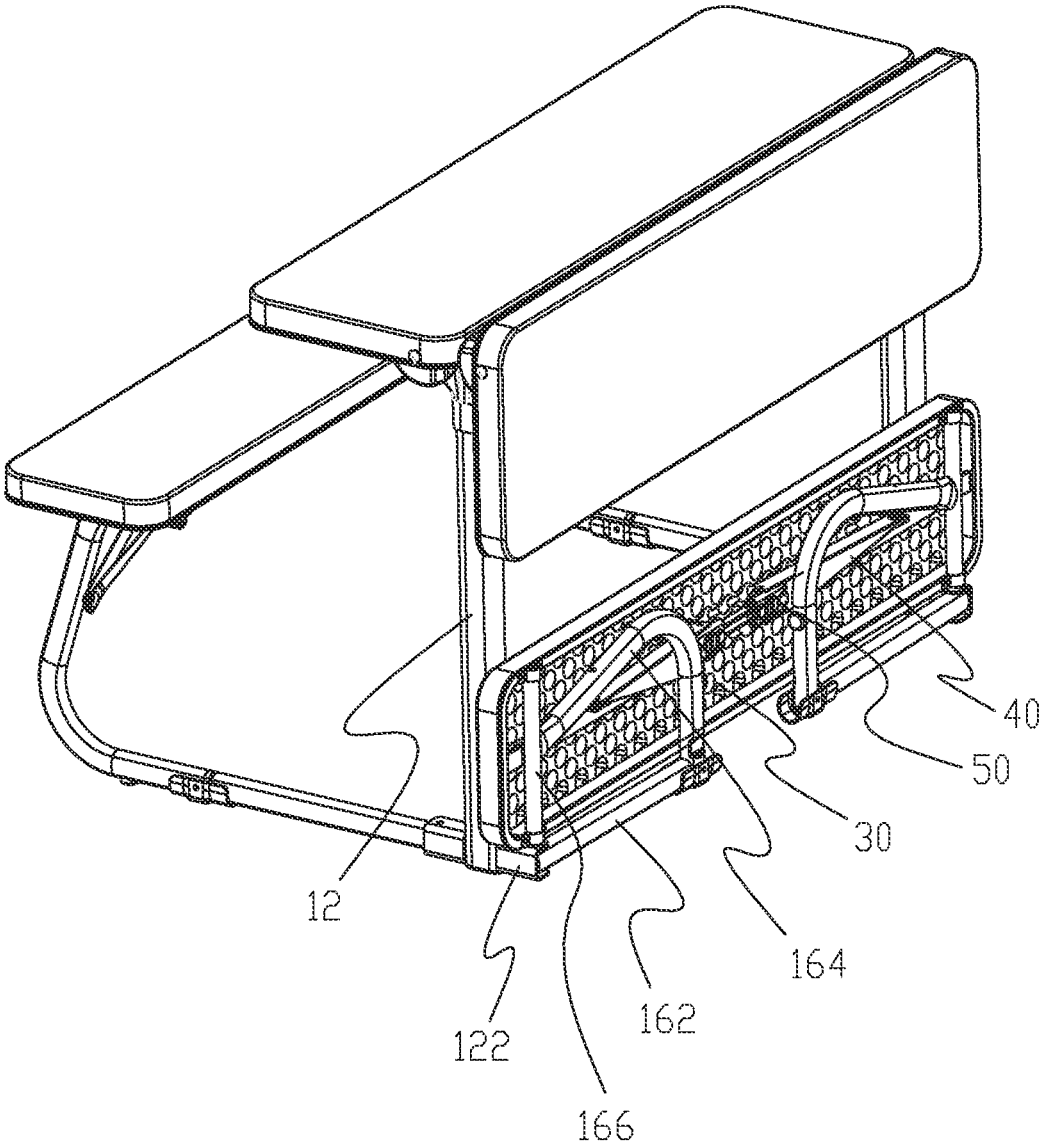
FIG. 6 illustrates a perspective view of the foldable table bench shown in FIG. 1 after a swing arm and a connecting arm disposed below the bench board are folded.

Referring to FIGS. 5 and 6, in the folded state, the connecting arms 164 and a first bench board 30 rotate toward the side of the supporting rod 12 to switch the first bench board 30 to a vertical position. The connecting shaft 166 is also switched to the vertical position, and the swing arm 162 and the connecting arm 164 can rotate toward the inner side of the first bench board 30 and together lean against a bottom of the bench board 30.

Figure 7:
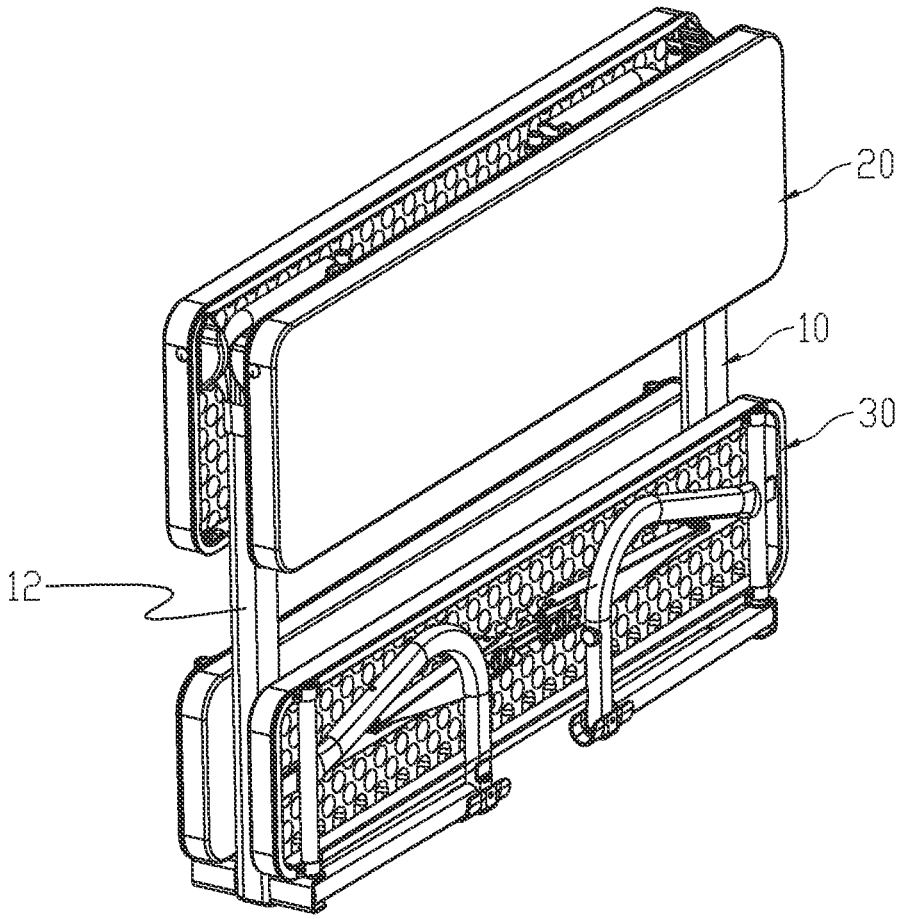
FIG. 7 illustrates a perspective view of the foldable table bench shown in FIG. 1 and disposed in a folded state.

Referring to FIG. 7, a second table board 20 and a second bench board 30 are folded in the same way.

In some embodiments, in the folded state, a rotation axis between the swing arm 162 and the supporting rod 12 is aligned with the connecting shaft 166, so that the swing arm 162 and the connecting arm 164 rotate inward more smoothly. Further, the bottom portion of the supporting rod 12 is disposed with a C-shaped frame 122, and the inner end of the swing arm 162 is disposed in the C-shaped frame 122 to be rotatably connected to the C-shaped frame 122. In the folded state, the bench board 30 stands on the C-shaped frame 122 and abuts an outer side of the supporting rod 12. Therefore, the structure is more compact in the folded state.

In some embodiments, the connecting arm 164 defines a C-shape with an opening toward the frame 10 to have better bearing capacity.

Referring to FIGS. 5 and 6, in some embodiments, a middle portion of a bottom surface of the bench board 30 is longitudinally disposed with a reinforcing rod 32, and a connecting rod 40 is connected between the connecting arm 164 and the reinforcing rod 32. One end of the connecting rod 40 is pivotally connected to the connecting arm 164, the other end of the connecting rod 40 is pivotally connected to a sliding sleeve 50, and the sliding sleeve 50 is slidably disposed on the reinforcing rod 32. In the unfolded state, the connecting rod 40 is configured to provide a supporting force to a middle portion of the bench board 30 to enhance a bearing capacity of the bench board 30. In some embodiments, the reinforcing rod 32 comprises an insertion hole 52, and the sliding sleeve 50 is disposed with a movable pin 51. In the unfolded state, the movable pin 51 is disposed in the insertion hole 52.

Referring to FIGS. 2 and 3, in some embodiments, an outer end of the crossbar 14 comprises a convex point 142, and the bottom surface of the table board 20 is disposed with a snapping block 22 corresponding to the crossbar 14. The snapping block 22 is disposed with a sliding groove 221 defining an arc-shape corresponding to the convex point 142, and an end of the sliding groove 221 defines a positioning hole 222. In the unfolded state, the convex point 142 is maintained in the positioning hole 222. When the convex point 142 and the sliding groove 221 begin to relatively slide, a frictional force is needed to ensure that the convex point 142 is better maintained in the positioning hole 222. The crossbar 14 is driven to rotate only under an external force. Further, a handle 144 is disposed on an outer end of the crossbar 14.

In some embodiments, left sides and right sides of top ends of the two supporting rods 12 are respectively disposed with connecting pieces 124, and the connecting pieces 124 are pivotally connected to the table boards 20. Sides of the table boards 20 are disposed with baffles 24 configured to cover the connecting pieces 124 from outer sides. The frame 10 further comprises a fixed rod 18 connected between the two supporting rods 12.

Figure 8:
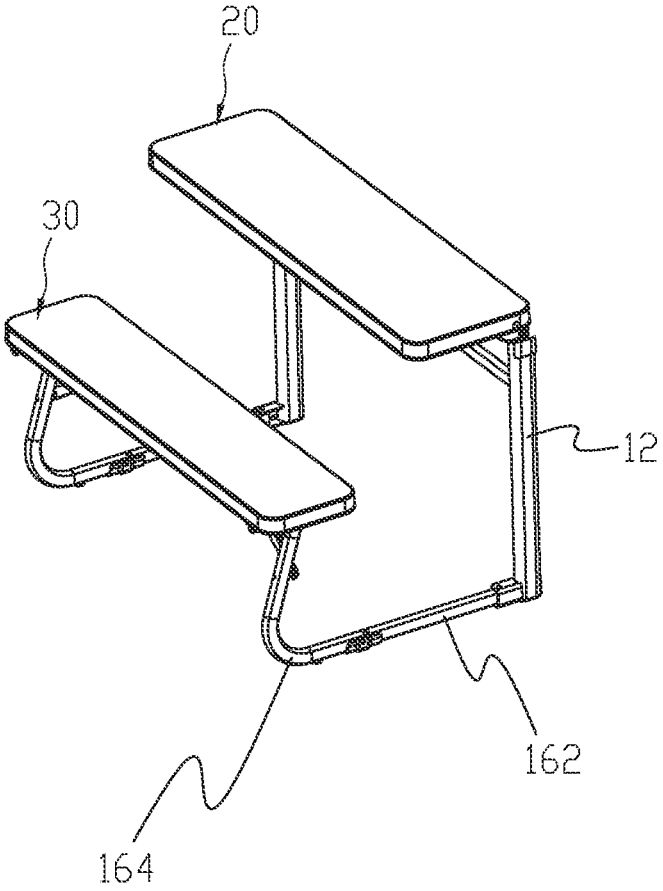
FIG. 8 illustrates a perspective view of a foldable table bench of a second embodiment of the present disclosure.

It is understandable that with respect to the foldable table bench of the present disclosure, the table boards 20 disposed on the left side and the right side are independent, and the bench boards 30 disposed on the left side and the right side also are independent. Therefore, the foldable table bench can also be designed into a structure comprising a single table board and a single bench board. That is, a table board 20 and a bench board 30 are merely disposed on a single side of the frame 10, which also has a foldable function, as illustrated in Embodiment 2 shown in FIG. 8.

Figure 9:
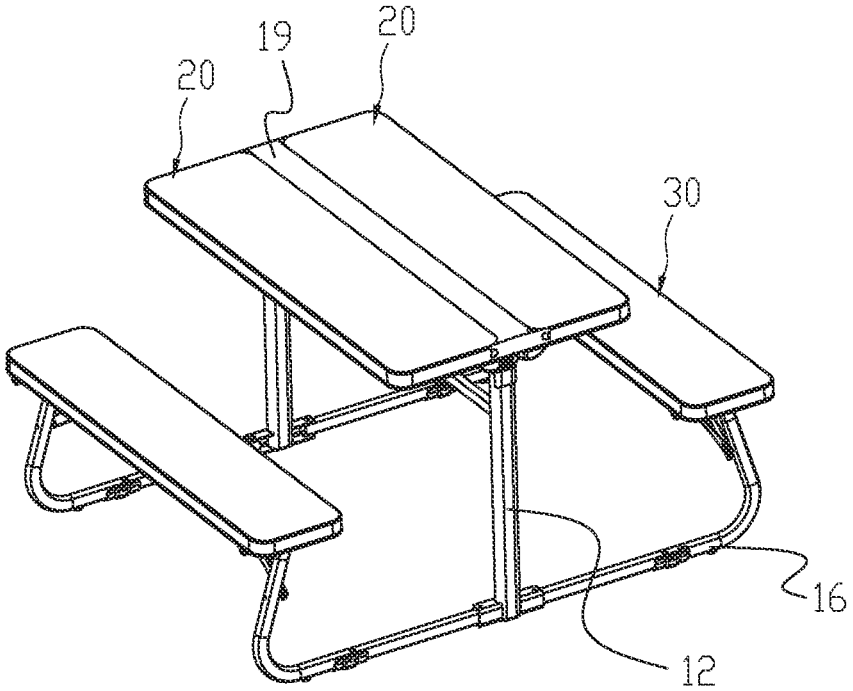
FIG. 9 illustrates a perspective view of a foldable table bench of a third embodiment of the present disclosure.

Referring to FIG. 9, a foldable table bench of Embodiment 3 of the present disclosure is illustrated. This embodiment differs from Embodiment 1 in that the table boards 20 are not pivotally connected to the two supporting rods 12 of the frame 10, and the frame 10 is further disposed with a middle board 19. The middle board 19 is horizontally disposed back and forth and is connected to the top portions of the two supporting rods 12. Two sides of the table boards 20 are pivotally connected to the middle board 19, and the table boards 20 are configured to rotate relative to the middle board 19. In the unfolded state, the table boards 20 are horizontally disposed in a plane disposed with the middle board 19, and the middle board 19 is positioned between the table boards 20. In the folded state, the table boards 20 rotate downward to be vertically positioned. The middle board 19 is disposed between the table boards 20, and the middle board 19 is configured to fill a gap between the table boards 20 and prevent fingers from being inserted between the table boards 20 that might result in safety accidents. Similarly, the frame 10 is further disposed with the crossbars 14 to support the table boards 20. In the folded state, the crossbars 14 rotate to be stored under the middle board 19, and the table boards 20 rotate downward to be vertically positioned.

Figure 10:
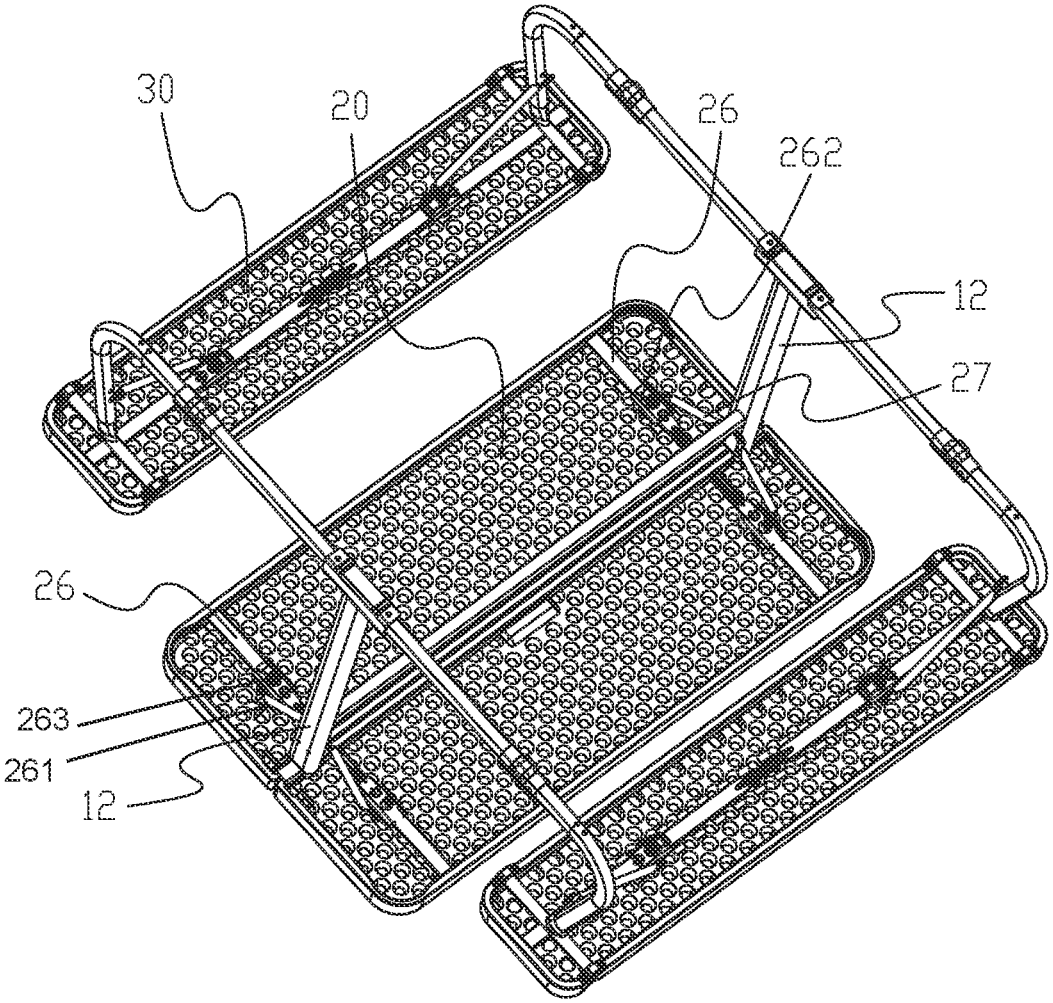
FIG. 10 illustrates a perspective view of a foldable table bench of a fourth embodiment of the present disclosure.
Figure 11:
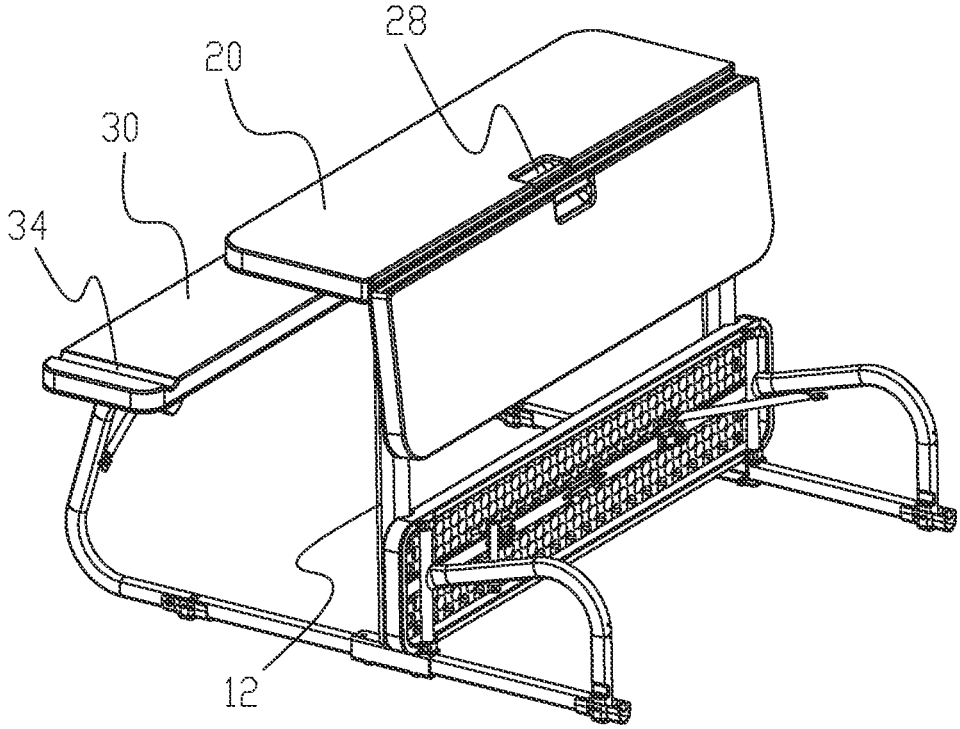
FIG. 11 illustrates a perspective view of the foldable table bench shown in FIG. 10 with a table board and a bench board on one side of the foldable table bench being folded.

Referring to FIGS. 10 and 11, a foldable table bench of Embodiment 4 of the present disclosure differs from Embodiment 1 in that the two sides of the bottom portion of the table board 20 (i.e., the first table board 20 or the second table board 20 of the pair of table boards 20) are disposed with two guide rods 26 corresponding to the two supporting rods 12. The two guide rods 26 are disposed with sliding bases 262, and the sliding bases 262 are configured to slide along the two guide rods 26. The two guide rods 26 comprise lock holes 261, and the sliding bases 262 are disposed with movable pins 263. The movable pins 263 are disposed in the lock holes 261 to enable positions of the sliding bases 262 to be limited and to enable the table board 20 to be maintained in a horizontal state. When the table board 20 needs to be folded, the movable pins are configured to be separated from the lock holes. That is, the movable pins of the two guide rods 26 disposed on the two sides are operated by two hands from a lower side of the table board 20. Bearing rods 27 are disposed between the sliding bases 262 and the two supporting rods 12, and two ends of the bearing rods 27 are pivotally and respectively connected to the sliding bases 262 and the two supporting rods 12. In the unfolded state, the movable pins are disposed in the lock holes, the bearing rods 27 support the lower side of the table board 20 to enable the table board 20 be maintained in the horizontal position. In the folded state, the movable pins are pulled out from the lock holes, and the table board 20 is configured to rotate downward to be vertically positioned. Top surfaces of the bench boards 30 comprise space-giving grooves 34 corresponding to the two supporting rods 12. In the folded state, the space-giving grooves 34 are buckled on the two supporting rods 12. Middle portions of inner sides of top surfaces of the table boards 20 comprise handle grooves 28 to facilitate the foldable table bench being lifted.

Figure 12:
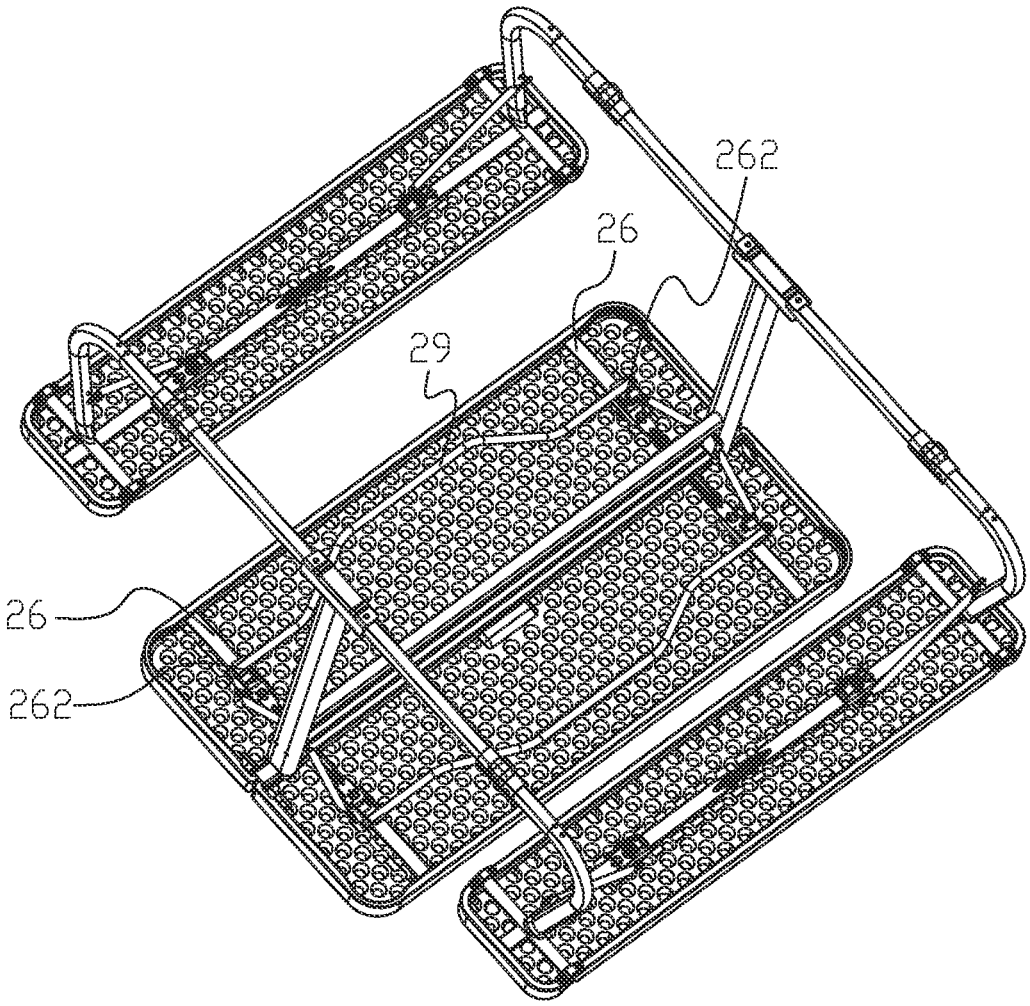
FIG. 12 illustrates a perspective view of a foldable table bench of a fifth embodiment of the present disclosure.

Referring to FIG. 12, a foldable table bench of Embodiment 5 of the present disclosure differs from Embodiment 4 in that a pull rod 29 is connected between the two guide rods 26 disposed below the table board 20. Two ends of the pull rod 29 are respectively rotatably connected to the two guide rods 26, and the pull rod 29 is operatively connected to the movable pins of two sliding bases 262. That is, the pull rod 29 rotates to enable buttons disposed on the two sliding bases 262 to be simultaneously pressed to drive the movable pins of the two sliding bases 262 to be pulled out from the lock holes, and it is more convenient to fold the table board 20.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foldable table bench having a folded state and an unfolded state, comprising:

a frame, a table board disposed on one side of the frame, and a bench board disposed on the one side of the frame, wherein:

the frame comprises two supporting rods vertically disposed side by side and back and forth, the frame is disposed with a pair of link rod mechanisms corresponding to the bench board, the link rod mechanisms are respectively connected to bottom portions of the supporting rods, each of the link rod mechanisms comprises a swing arm and a connecting arm rotatably connected together, the swing arm is supported on ground, the swing arm is rotatably connected to the supporting rod, the connecting arm is disposed with a connecting shaft, the connecting shaft supports a bottom portion of the bench board, the connecting shaft is disposed along a width direction of the bench board and is rotatably connected to the bench board, two sides of the table board are pivotally connected to top portions of the supporting rods, two sides of a bottom portion of the table board are disposed with two guide rods corresponding to the supporting rods, the guide rods are disposed with sliding bases, the sliding bases are configured to slide along the guide rods, the guide rods comprise lock holes, the sliding bases are disposed with first movable pins, bearing rods are disposed between the sliding bases and the supporting rods, two ends of the bearing rods are respectively and pivotally connected to the sliding bases and the supporting rods, in the unfolded state, the link rod mechanisms support a lower side of the bench board to enable the bench board to be maintained in a horizontal position and the first movable pins are disposed in the lock holes, and the bearing rods support a lower side of the table board to enable the table board to be maintained in the horizontal position, and in the folded state, the connecting arms and the bench board rotate toward the supporting rods to enable the bench board to be switched to a vertical position and the swing arms, the connecting arms rotate toward an inner side of the bench board and abut the bottom portion of the bench board, the first movable pins are pulled out from the lock holes, and the table board rotates downward to be vertically positioned.

2. The foldable table bench according to claim 1, wherein:

in the folded state, the connecting shafts and rotation axes of the swing arms respectively define straight lines.

3. The foldable table bench according to claim 2, wherein:

the bottom portions of the supporting rods are disposed with C-shaped frames, inner ends of the swing arms are disposed in the C-shaped frames and are rotatably connected to the C-shaped frames, and in the folded state, the bench board stands on the C-shaped frames and abuts outer sides of the supporting rods.

4. The foldable table bench according to claim 1, wherein the connecting arms bend to define C-shapes.

5. The foldable table bench according to claim 1, wherein:

a middle portion of a bottom surface of the bench board is longitudinally disposed with a reinforcing rod, a connecting rod is connected between the connecting arm and the reinforcing rod, a first end of the connecting rod is pivotally connected to the connecting arm, a second end of the connecting rod is pivotally connected to a sliding sleeve, the sliding sleeve is slidably disposed on the reinforcing rod, the reinforcing rod is disposed with an insertion hole, the sliding sleeve is disposed with a second movable pin, and in the unfolded state, the second movable pin is disposed in the insertion hole.

6. The foldable table bench according to claim 1, comprising:

the frame further comprises a middle board connected to top portions of the supporting rods, the table boards are respectively and pivotally connected to the middle board, and in the unfolded state, the table boards are horizontally positioned and are disposed in a plane with the middle board, and the middle board is disposed between the table boards.

7. The foldable table bench according to claim 6, wherein:

a pull rod is connected between the guide rods disposed below the table boards, the pull rod is rotatably connected to the guide rods, the pull rod is operatively connected to the first movable pins of the sliding bases, and the pull rod rotates to drive the first movable pins to be pulled out from the lock holes.

8. The foldable table bench according to claim 6, wherein:

top surfaces of the bench boards comprise space-giving grooves corresponding to the supporting rods, and in the folded state, the space-giving grooves are buckled on the supporting rods.

9. The foldable table bench according to claim 1, wherein:

a pull rod is connected between the guide rods disposed below the table board, the pull rod is rotatably connected to the guide rods, the pull rod is operatively connected to the first movable pins of the sliding bases, and the pull rod rotates to drive the first movable pins to be pulled out from the lock holes.

10. The foldable table bench according to claim 1, wherein:

a top surface of the bench board comprises space-giving grooves corresponding to the supporting rods, and in the folded state, the space-giving grooves are buckled on the supporting rods.

11. The foldable table bench according to claim 1, wherein:

a left side and a right side of the frame are symmetrically disposed with two of the table boards, and a left side and a right side of the frame are symmetrically disposed with two of the bench boards.

12. A foldable table bench having a folded state and an unfolded state, comprising:

a frame, a table board disposed on one side of the frame, and a bench board disposed on the one side of the frame, wherein:

the frame comprises two supporting rods vertically disposed side by side and back and forth, the frame is disposed with a pair of link rod mechanisms corresponding to the bench board, the link rod mechanisms are respectively connected to bottom portions of the supporting rods, each of the link rod mechanisms comprises a swing arm and a connecting arm rotatably connected together, the swing arm is supported on ground, the swing arm is rotatably connected to the supporting rod, the connecting arm is disposed with a connecting shaft, the connecting shaft supports a bottom portion of the bench board, the connecting shaft is disposed along a width direction of the bench board and is rotatably connected to the bench board, a middle portion of a bottom surface of the bench board is longitudinally disposed with a reinforcing rod, a connecting rod is connected between the connecting arm and the reinforcing rod, a first end of the connecting rod is pivotally connected to the connecting arm, a second end of the connecting rod is pivotally connected to a sliding sleeve, the sliding sleeve is slidably disposed on the reinforcing rod, the reinforcing rod is disposed with an insertion hole, the sliding sleeve is disposed with a movable pin, in the unfolded state, the link rod mechanisms support a lower side of the bench board to enable the bench board to be maintained in a horizontal position and the movable pin is disposed in the insertion hole, and in the folded state, the connecting arms and the bench board rotate toward the supporting rods to enable the bench board to be switched to a vertical position and the swing arms and the connecting arms rotate toward an inner side of the bench board and abut the bottom portion of the bench board.

13. A foldable table bench having a folded state and an unfolded state, comprising:

a frame, a table board disposed on one side of the frame, and a bench board disposed on the one side of the frame, wherein:

the frame comprises two supporting rods vertically disposed side by side and back and forth, the frame is disposed with a pair of link rod mechanisms corresponding to the bench board, the link rod mechanisms are respectively connected to bottom portions of the supporting rods, each of the link rod mechanisms comprises a swing arm and a connecting arm rotatably connected together, the swing arm is supported on ground, the swing arm is rotatably connected to the supporting rod, the connecting arm is disposed with a connecting shaft, the connecting shaft supports a bottom portion of the bench board, the connecting shaft is disposed along a width direction of the bench board and is rotatably connected to the bench board, in the unfolded state, the link rod mechanisms support a lower side of the bench board to enable the bench board to be maintained in a horizontal position, and in the folded state, the connecting arms and the bench board rotate toward the supporting rods to enable the bench board to be switched to a vertical position and the swing arms, the connecting arms rotate toward an inner side of the bench board and abut the bottom portion of the bench board, and the connecting shafts and rotation axes of the swing arms respectively define straight lines.

14. A foldable table bench having a folded state and an unfolded state, comprising:

a frame, a table board disposed on one side of the frame, and a bench board disposed on the one side of the frame, wherein:

the frame comprises two supporting rods vertically disposed side by side and back and forth, the frame is disposed with a pair of link rod mechanisms corresponding to the bench board, the link rod mechanisms are respectively connected to bottom portions of the supporting rods, each of the link rod mechanisms comprises a swing arm and a connecting arm rotatably connected together, the swing arm is supported on ground, the swing arm is rotatably connected to the supporting rod, the connecting arm is disposed with a connecting shaft, the connecting shaft supports a bottom portion of the bench board, the connecting shaft is disposed along a width direction of the bench board and is rotatably connected to the bench board, two sides of the table board are pivotally connected to top portions of the supporting the frame is disposed with a pair of crossbars corresponding to the table board, the crossbars are respectively and rotatably connected to the top portions of the supporting rods, in the unfolded state, the link rod mechanisms support a lower side of the bench board to enable the bench board to be maintained in a horizontal position, and the crossbars support a lower side of the table board to enable the table board to be maintained in the horizontal position, and in the folded state, the connecting arms and the bench board rotate toward the supporting rods to enable the bench board to be switched to a vertical position and the swing arms, the connecting arms rotate toward an inner side of the bench board and abut the bottom portion of the bench board, the crossbars rotate and abut an inner side of the table board and the table board rotates downward to be vertically positioned.

15. The foldable table bench according to claim 14, wherein:

outer ends of the crossbars are disposed with convex points, a bottom surface of the table board is disposed with snapping blocks corresponding to the crossbars, the snapping blocks are disposed with sliding grooves defining arc-shapes and corresponding to the convex points, ends of the sliding grooves define positioning holes, and in the unfolded state, the convex points are maintained in the positioning holes.

* * * * *